United States Patent [19]

Jenks

[11] 4,216,625

[45] Aug. 12, 1980

[54] WELL PUMP STRIPPING TOOL

[76] Inventor: Harry E. Jenks, P.O. Box 742, Elkhart, Kans. 67950

[21] Appl. No.: 915,789

[22] Filed: Jun. 15, 1978

[51] Int. Cl.[2] ..... B24B 41/02

[52] U.S. Cl. ..... 51/34 G; 51/47

[58] Field of Search ..... B24B/27/04; 51/34 C, 51/34 G, 37, 47, 217 R, 34 F; 269/126, 129, 321 N; 83/471.3, 455, 464, 574, 485; 409/226, 236

[56] References Cited

U.S. PATENT DOCUMENTS

| | | | |
|---|---|---|---|
| 667,321 | 2/1901 | Keyes | 51/34 E |
| 2,108,077 | 2/1938 | Robinson | 269/129 X |
| 2,109,827 | 3/1938 | Moffett | 51/34 C |
| 2,340,553 | 2/1944 | Obear | 51/217 R |
| 3,477,179 | 11/1969 | Dale | 51/34 C |
| 3,757,618 | 9/1973 | Kuts | 83/471.3 |
| 3,864,877 | 2/1975 | Doll | 51/34 F |

FOREIGN PATENT DOCUMENTS

| | | | |
|---|---|---|---|
| 23284 | 10/1906 | United Kingdom | 51/48 HE |

*Primary Examiner*—Gary L. Smith
*Attorney, Agent, or Firm*—Edwin H. Crabtree

[57] ABSTRACT

A well pump stripping tool designed for stripping bottom hole oil field plunger-type pumps. The well pump stripping tool used for removing a pump barrel surrounding a plunger when the plunger becomes inoperable due to contamination causing the seizing of the plunger to the inner diameter of the pump barrel. Also the well pump stripping tool may be used for removing well tubing surrounding the pump barrel when the tubing becomes stuck to the outer diameter of the pump barrel.

5 Claims, 7 Drawing Figures

WELL PUMP STRIPPING TOOL

Background of the Invention

This invention relates to a stripping tool used for removing a tubular member which is seized to another tubular member which has been slidably received therein, and more particularly, but not by way of limitation, to a stripping tool used for removing a pump barrel surrounding a well pump plunger.

Heretofore, when bottom hole oil field plunger-type pumps become contaminated with materials, such as fine-grained gypsum, pumped through the interior of the pump, the reciprocating pump plunger seizes against the interior walls of the pump barrel rendering the pump inoperable. To free the plunger from the pump barrel, the pump is often treated chemically or mechanical force is used which is time consuming, expensive, and often unsuccessful. Therefore, the old pump is discarded and a new pump is purchased.

There have been prior art patents used for cutting and breaking apart casts used for setting broken bones. These cast splinting devices are dissimilar to the subject invention and do not provide the structure needed and required to break apart metal tubing.

Summary of the Invention

The subject invention helps reduce the cost of oil field pump maintenance by providing for the salvaging of pump barrels and pump plungers used in oil field plunger-type pumps.

The tool is easy to operate, rugged in construction, and can be used to quickly remove tubing and pump barrels surrounding a pump plunger which has been seized together due to contamination in the fluid pumped.

The invention eliminates the need of trying to free the plunger in the pump barrel with mechanical force or treating the plunger with chemical solutions to dissolve the contaminates.

The subject invention includes an elongated stand adapted for receiving and holding the plunger and pump barrel thereon. The stand includes pipe clamps for securing the plunger and pump barrel on top of the stand. A trolley is mounted on top of the stand for traveling along the length of the stand and straddling the plunger and pump barrel thereon. A grinder having a grinder wheel is attached to a grinder holder which is pivotally mounted on the trolley. A pivot adjustment arm is attached to the grinder holder for adjusting the movement of the grinder and controlling the depth of cut in the pump barrel by the grinder wheel. A drive sprocket with a handle is attached to the trolley. The sprocket engages a drive chain attached to and extending along the length of the stand. By turning the handle, the drive sprocket moves the trolley along the length of the stand.

The advantages and objects of the invention will become evident from the following detailed description when read in conjunction with the accompanying drawings which illustrate the preferred embodiments of the invention.

Brief Description of the Drawings

FIG. 6 illustrates an enlarged front view of the pipe breaker.

Detailed Description of the Drawings

Figure 1:
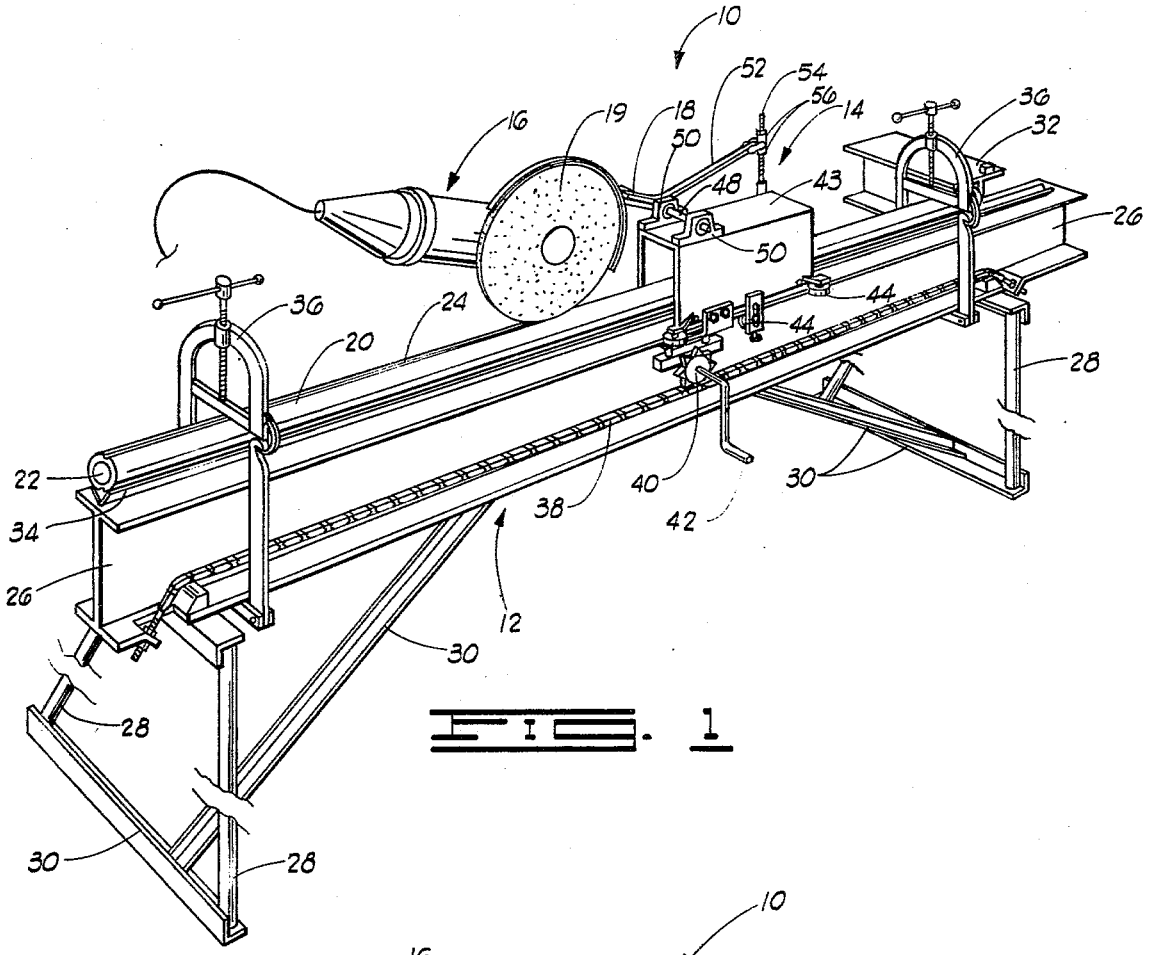
FIG. 1 is a perspective view of the well pump stripping tool.

In FIG. 1, the well pump stripping tool is designated by general reference numeral 10. Broadly the tool 10 includes an elongated stand 12, a trolley 14, which is mounted on top of the stand 12 and travels along the length thereof, and a grinder 16 with a grinder holder 18 pivotally mounted on top of the trolley 14.

The grinder 16 includes a grinder wheel 19, which engages a pump barrel 20 having a plunger 22 therein. The grinder wheel 19 is adapted for cutting an elongated slot 24 along the length of the pump barrel 20.

The stand 12 includes an "I" beam 26 mounted on top of a pair of stand legs 28 having bracing 30. The stand 12 further includes a stand extension 32 which is attached to one end of the "I" beam 26 and perpendicular thereto. The stand extension 32 is discussed under FIG. 4. The stand 12 also includes a "V"-shaped pipe guide 34 attached to the top of the "I" beam 26 and extending along the length thereof. The pipe guide 34 is used for receiving the plunger 22 and pump barrel 20 thereon. A pair of pipe clamps 36 are attached to the ends of the "I" beam 26 and are used for holding the plunger 22 and pump barrel 20 on the pipe guide 34. Also attached to the ends of the "I" beam 26 and extending along the length of the "I" beam 26 is a drive chain 38. The drive chain 38 is engaged by a drive sprocket 40 which is rotated by a drive sprocket handle 42. The drive sprocket 40 is rotatably attached to the trolley 14.

Figure 2:
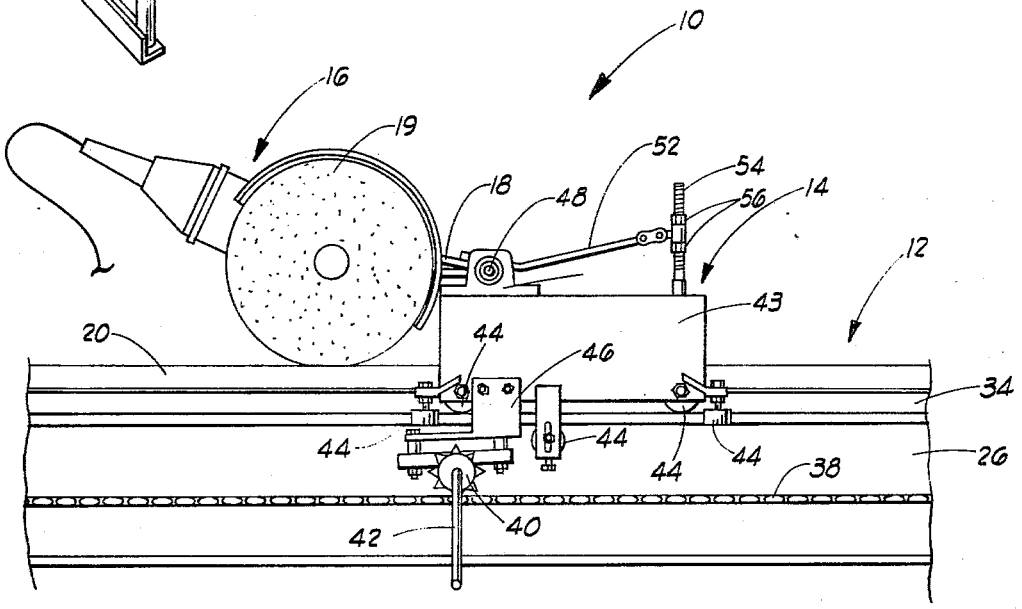
FIG. 2 is a front view of the grinder and trolley with a grinder wheel cutting a slot into a pump barrel mounted on top of the stand.

In both FIGS. 1 and 2, the detailed structure of the trolley 14 and grinder 16 can be seen. The trolley 14 includes an inverted "U"-shaped trolley housing 43 for straddling the pump barrel 20 on the stand 12. The housing 43 has a plurality of trolley wheels 44 which ride on the top and bottom of the upper portion of the "I" beam 26. The wheels 44 guide the trolley 14 along the length of the top of the "I" beam 26. Extending downwardly from the trolley housing 43 is an adjustment arm 46 which is attached to the sprocket 40. The adjustment arm 46 may be raised and lowered for adjusting the sprocket 40 on the drive chain 38.

The grinder holder 18 is attached to a pivot shaft 48 which is mounted on pillow block bearings 50 attached to the top of the trolley housing 43. The grinder holder 18 is also attached to a pivot adjustment arm 52. The adjustment arm 52 is attached to a threaded bolt 54 with locking nuts 56. By adjusting the pivot adjustment arm 52 on the threaded bolt 54, the vertical movement of the grinder wheel 19 can be controlled so that the proper depth of the slot 24 may be cut in the pump barrel 20. This is important since the outer circumference of the plunger 22 has a highly finished surface and to cut completely through the pump barrel 20 may risk scratching the surface of the plunger 22.

Figure 3:
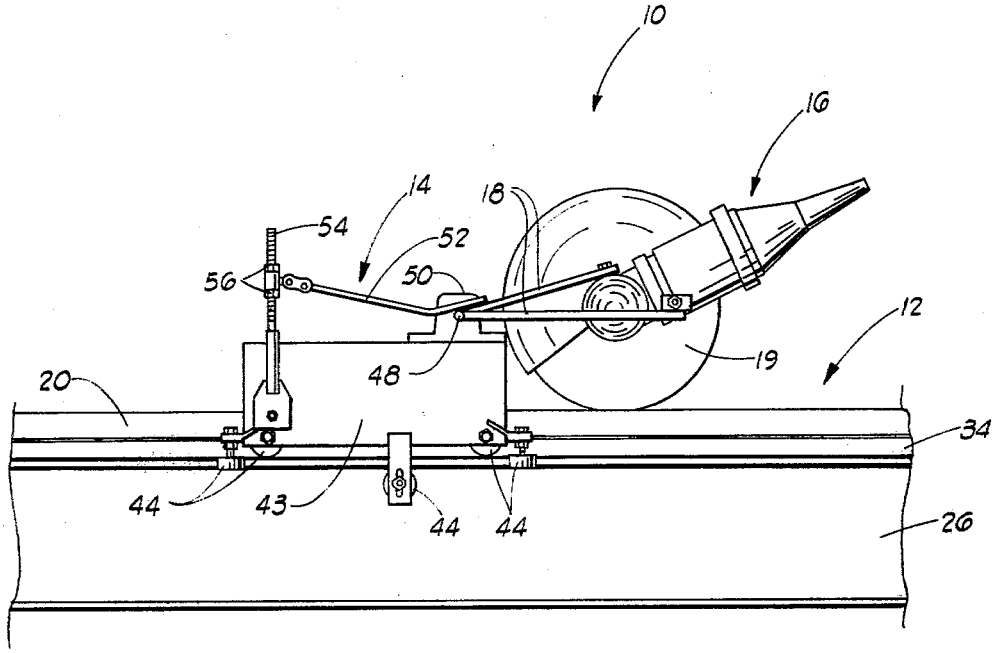
FIG. 3 is a rear view of the grinder and trolley mounted on the stand.

In FIG. 3, a rear view of the trolley 14 and grinder 16 is shown. In this view, the trolley 14 can be seen straddling the pump barrel 20 and the trolley wheels 44 engaging the opposite side of the upper portion of the "I" beam 26. The grinder holder 18 positions the grinder 16 so that the grinding wheel 19 is centered over the length of the plunger 22 and barrel pump 20. As the trolley 14 moves along the length of the "I" beam 26, the grinder wheel 19 cuts a slot in the length of the pump barrel 20 so that the pump barrel 20 can be removed from the plunger 22.

Figure 4:
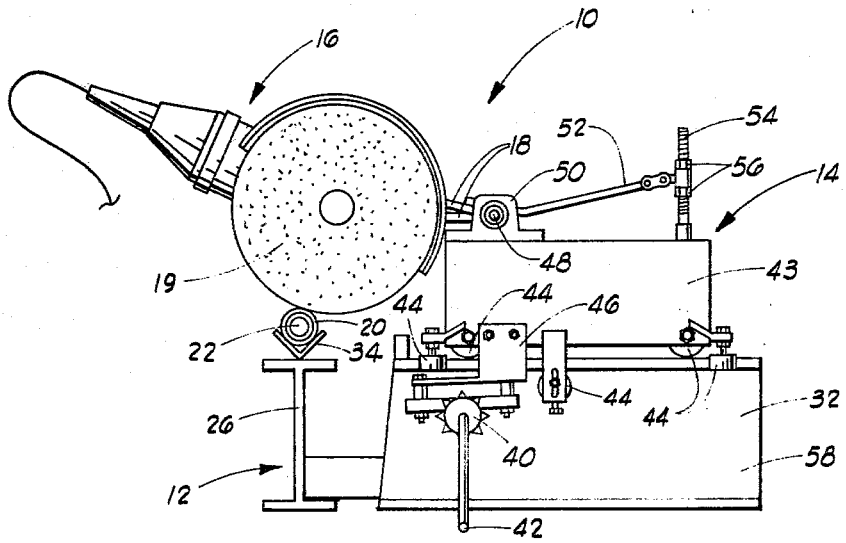
FIG. 4 illustrates the grinder with the grinder wheel cutting the pump barrel laterally with the trolley mounted on a stand extension.

In FIG. 4, the trolley 14 is shown removed from the "I" beam 26 and mounted on top of the stand extension 32. The stand extension 32 also has an "I" beam 58 for receiving the trolley wheels 44 thereon. The grinder 16 and grinder wheel 19 are now positioned laterally to the length of the plunger 22 and pump barrel 20. Because normally only the lower portion of the plunger 22 is seized inside the barrel 20 (i.e. the bottom 5 feet of a 30-foot pipe section), it is not required to slot and remove the entire length of the barrel 20 from the plunger 22. Therefore, it is desirable to cut only a certain length of the pump barrel 22. This is done by mounting the trolley 44 on the stand extension 32 and cutting laterally around the circumference of the barrel 20 as shown in the drawing. By rotating the barrel 20 in the pipe guide 34, the circumference of the plunger 22 is cut by the grinding wheel 19.

Figure 5:
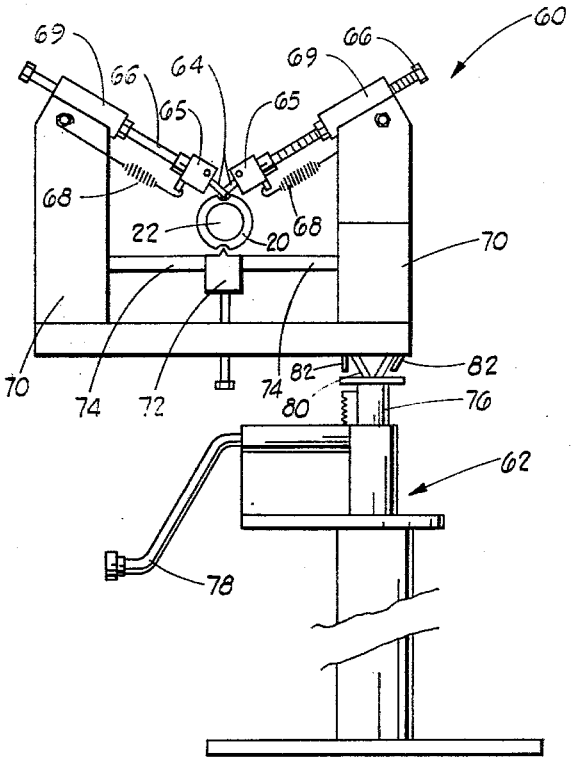
FIG. 5 illustrates a front view of a pipe breaker mounted on a pipe breaker stand.

In FIG. 5, a pipe breaker 60 is illustrated mounted on top of a pipe breaker stand 62. As mentioned above, in the cutting of the slot 24 along the length of the barrel 20, it is desirable that the depth of the slot 24 should not extend completely through the barrel 20, which would risk cutting into the outer circumference of the plunger 22. Also, in breaking apart the barrel 20 from the plunger 22, two elongated slots 24, 180° apart, are cut along the length of the barrel 22. When this has been completed, the plunger 22 and the pump barrel 20 are received on the pipe breaker 60 for breaking apart the pump barrel 20 from the plunger 22.

The pipe breaker 60 includes a pair of pipe jaws 64 pivotally mounted and oppositely disposed in jaw housings 65. The housings 65 are held on threaded adjustment bolts 66 by coil springs 68. The adjustment bolts 66 are threaded on bolt collars 69. The collars 60 are mounted opposite each other on top of a "U"-shaped pipe breaker housing 70. The pipe breaker housing 70 is "U"-shaped for receiving a portion of the plunger 22 and barrel 20 therein. The barrel 20 is supported on top of a pipe breaker guide 72. The pipe breaker guide 72 includes a pointed protuberance 73 which is inserted in one of the slots 24 cut in the barrel 20. The pipe breaker guide 72 further includes a pipe breaker guide plate 74 which prevents the pipe breaker guide 72 from turning in the housing 70.

The pipe breaker stand 62 includes a telescoping arm 76 which may be raised and lowered by rotating a handle 78. The top of the arm 76 includes a "V"-shaped guide 80 which is slidably received in downwardly extending guide arms 82 mounted on the bottom of the pipe breaker housing 70.

Figure 7:
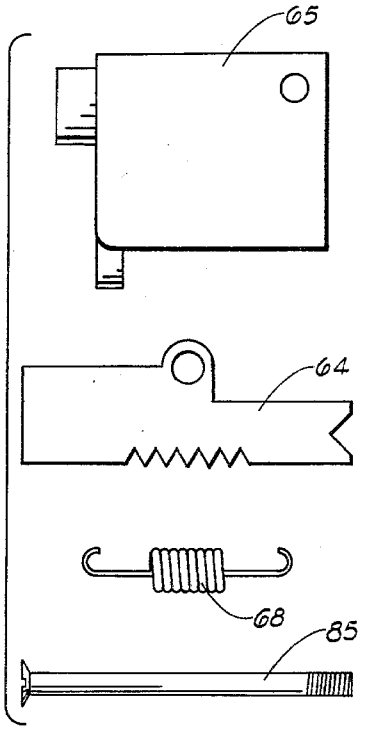
FIG. 7 illustrates individual parts of the pipe breaker.
Figure 8:
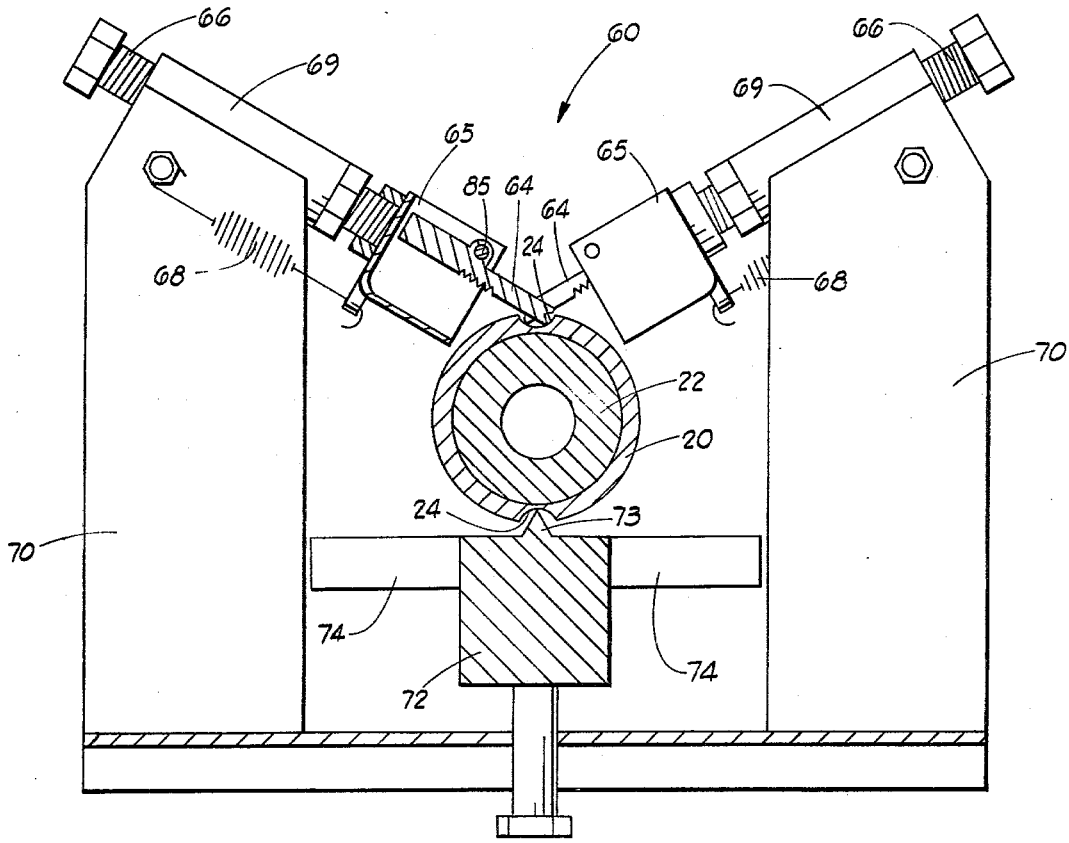

In FIG. 6, an enlarged front view of the pipe breaker 60 is illustrated showing a cross section of the pump barrel 20, plunger 22, and pipe breaker guide 72 received in the slot 24. Also shown in cross section is one of the jaw housings 65 and jaws 64. In this illustration, the jaw 64 can be seen pivotally attached to the housing 65 by a pivot pin 85. The pin 85 is also shown in detail in FIG. 7 having a threaded end portion for securing the jaw 64 to the housing 65.

In the operation of removing the pump barrel 20 from the plunger 22, the pump barrel 20 and plunger 22 are placed on top of the "I" beam 26 in pipe guide 34 and secured thereto by pipe clamps 36. The depth of cut into the barrel 20 is set by adjusting the pivot adjustment arm 52 which allows the grinder holder 18 to pivot the grinder 16 downwardly. The grinder 16 is then started and the slot 24 is cut along the length of the barrel 20 by slowly rotating the drive sprocket handle 42 which rotates the sprocket 40 on the drive chain 38 moving the trolley 14 along the length of the stand 12. When the slot 24 has been cut, the barrel 20 and plunger 22 are rotated approximately 180° on the stand 12 and a second slot 24 is cut at the same depth into the pump barrel 20. When the two slots have been cut to a desired length, the barrel 20 and plunger 22 are removed from the stand 12 or one end of the barrel 20 may be supported on the stand 12 with the other end of the barrel 20 inserted on the pipe breaker 60 with one of the slots 24 received on top of the pipe breaker guide 72. The pipe breaker stand 62 is adjusted to a desired height which normally would be the same height as the stand 12. The threaded adjustment bolts 66 are then threaded in or out so that the ends of the pipe jaws 64 are received against opposite sides of the second slot 24 in the pipe barrel 20. When the jaws 64 have been adjusted, the threaded adjustment bolts 66 are threaded inwardly on the bolt collars 69 forcing the ends of the pipe jaws 64 against the sides of the slot 24. As the threaded adjustment bolts 66 are continued to be turned inwardly, the jaws 64 begin to separate the sides of the pipe barrel 22 away from each other breaking apart the plunger 20 along the length of the slot 24 and pivoting about an axis along the length of the barrel 20 and through the center of the slot 24 received on top of the pipe breaker guide 72. As mentioned above, often it is not necessary to completely cut slots 24 along the entire length of the barrel 20, therefore, prior to cutting the slots 24 into the barrel 20, a lateral slot may be cut around the circumference of the barrel 20 as discussed under the description of FIG. 4. When the two sides of the barrel 20 have been separated away from the exterior surface of the plunger 22, the plunger 22 may now be reconditioned and reused in an oil field plunger-type pump.

It should be noted that while the above discusses the separation of the pump barrel 20 from the pump plunger 22, the tool 10 may be used equally well when well tubing becomes struck to the exterior circumference of the pump barrel due to pumping sand therebetween or any other contaminates. Also the tool 10 may be used for other types of metal tubing which require separation from an inner tubing or liner.

Changes may be made in the construction and arrangement of the parts or elements of the embodiments as disclosed herein without departing from the spirit of scope of the invention as defined in the following claims.

I claim:

1. A well pump stripping tool for removing a pump barrel surrounding a plunger, the tool comprising:

an elongated stand including an "I" beam mounted on stand legs and a "V" shaped pipe guide attached to the top of the "I" beam and extending along the length thereof, the pipe guide adapted for receiving and holding the plunger and pump barrel thereon;

an inverted "U" shaped trolley, the trolley having trolley wheels riding on the top and the bottom of the upper portion of the "I" beam, the wheels guiding the trolley along the length of the top of the "I" beam and straddling the pump barrel and plunger thereon;

a grinder having a grinder wheel and a grinder holder, the grinder holder attached to a pivot shaft mounted on top of the trolley, the holder also attached to a pivot adjustment arm, the arm vertically adjustable on top of the trolley, by adjusting the arm the holder is pivoted on the pivot shaft thereby adjusting the vertical movement of the grinder wheel which is suspended above the pump barrel so that the proper depth of slot is cut along the length of the pump barrel as the grinder wheel is guided along the length of the pump barrel; and drive means attached to the trolley and the "I" beam for moving the trolley on top of the "I" beam and along the length thereof.

2. The tool as described in claim 1 wherein the drive means includes a drive sprocket rotatably attached to the trolley, a drive sprocket handle attached to the drive sprocket and a drive chain attached to and disposed along the length of the "I" beam, the drive sprocket engaging the drive chain, when the sprocket handle is rotated the drive sprocket moving the trolley along the length of the "I" beam.

3. The tool as described in claim 1 further including pipe clamps mounted at the ends of the "I" beam for securing the plunger and pump barrel on top of the "V" shaped pipe guide.

4. The tool as described in claim 1 further including a stand extension attached to one end of the stand and perpendicular thereto, the trolley and the grinder adapted for mounting on the stand extension with the grinder wheel engaging the pump barrel and cutting a slot along the circumference of the pump barrel.

5. A well pump stripping tool for removing a pump barrel surrounding a plunger, the tool comprising:

an elongated stand including an "I" beam mounted on stand legs and a "V" shaped pipe guide attached to the top of the "I" beam for receiving the plunger and pump barrel thereon;

an inverted "U" shaped trolley, the trolley having trolley wheels for riding on the top and the bottom of the upper portion of the "I" beam, the wheels guiding the trolley along the length of the top of the "I" beam and straddling the pump barrel and plunger thereon;

a grinder having a grinder wheel and a grinder holder, the grinder holder attached to a pivot shaft mounted on top of the trolley, the holder also attached to a pivot adjustment arm, the arm vertically adjustable on top of the trolley, by adjusting the arm the holder is pivoted on the pivot shaft thereby adjusting the vertical movement of the grinder wheel which is suspended above the pump barrels so that the proper depth of a slot is cut along the length of the pump barrel as the grinder wheel is guided along the length of the pump barrel;

a drive sprocket rotatably attached to the trolley, the sprocket having a drive sprocket handle attached thereto, the sprocket engaging a drive chain disposed along the length of the "I" beam and attached thereto, when the sprocket handle is rotated the drive sprocket moves the trolley along the length of the "I" beam; and a stand extension attached at one end to the stand and perpendicular thereto, the trolley and the grinder adapted for mounting on the stand extension with the grinder wheel engaging the pump barrel and cutting a slot along the circumference of the pump barrel.

* * * * *